United States Patent [19]

Trauschke

[11] Patent Number: 4,921,099

[45] Date of Patent: May 1, 1990

[54] LAMP CARTON WITH FALSE, ANGLED TRAP

[75] Inventor: William F. Trauschke, Topsfield, Mass.

[73] Assignee: GTE Products Corporation, Danvers, Mass.

[21] Appl. No.: 276,753

[22] Filed: Nov. 28, 1988

[51] Int. Cl.[5] ..... B65D 85/42

[52] U.S. Cl. ..... 206/418; 206/45.14; 206/491

[58] Field of Search ..... 206/45.14, 45.19, 418, 206/521, 583, 525, 491

[56] References Cited

U.S. PATENT DOCUMENTS

| | | | |
|---|---|---|---|
| 1,838,269 | 12/1931 | Langford et al. | 206/418 |
| 2,421,748 | 6/1947 | Fink | 206/418 |
| 2,537,151 | 1/1951 | Mires | 206/418 |
| 3,337,033 | 8/1967 | Cote | 206/418 |
| 4,200,192 | 4/1980 | Klomp | 206/45.14 |
| 4,445,613 | 5/1984 | Cassidy | 206/418 |
| 4,773,539 | 9/1988 | Nock | 206/45.14 |

*Primary Examiner*—David T. Fidei

*Attorney, Agent, or Firm*—William E. Meyer

[57] ABSTRACT

A paperboard container for an electric lamp which is in the form of a parallelepiped having an end platform recessed inwardly from an end of the container side walls. The platform is triangular and has a quadrilateral panel which projects axially into the container enclosure which is pushed to one side by a container lamp and acts as a positioner and shock absorber for the lamp. The container is formed from a unitary blank of single ply paperboard material which has a plurality of cutouts and fold lines to provide the various panels of which the container is comprised.

20 Claims, 6 Drawing Sheets

LAMP CARTON WITH FALSE, ANGLED TRAP

BACKGROUND OF THE INVENTION

The present invention relates to packages for electric lamps and more particularly to a container for an electric lamp having a bulbous shaped glass envelope formed at one end and a metallic base at the opposite end. The invention further relates to electric lamp packages manufactured from a unitary blank of single ply material.

In the field of electric lamp packaging, the prior art discloses a great number of packaging concepts, some directed to a particular application or lamp configuration while others are directed to a more general area of lamp production. In some packages, a separate corrugated paperboard carton having opposed open ends through which a single bulbous shaped lamp is inserted are further encased in a sleeve or similar element which covers the carton's open ends. Some cartons are directed to the packaging of two or more lamps within a single carton and contain separators or other means for defining a plurality of lamp receiving chambers, or compartments, to prevent the lamps from physically contacting each other while in the package. While attempts are often made in the lamp packages to provide attractive containers or those which display the contained lamp, the primary object of these packages is generally to prevent damage to 20e fragile electric lamps during shipping and handling.

The protective features of the package become extremely critical when providing a container for a fragile but relatively heavy lamp which may be costly to manufacture, such as a typical sodium lamp found on the market. The lamp is generally prepared for shipping by being packaged singly in a container and then being placed in a larger cardboard box with several other containers. To facilitate the handling of the sealed boxes in the warehouses and during loading and unloading, a number of boxes are usually placed on a pallet and the pallets are then stacked one upon the other. As a result of such stacking, the individual lamp containers in the shipping boxes are subject to compressive and jouncing stresses which may cause the container walls to buckle and collapse resulting in the glass bulbs being crushed and broken. In particular, and specifically for heavier lamps, a disproportionate amount of breakage has been found to result from axial motion of the lamp in the carton. Breakage may also occur during normal handling by the manufacturer, distributor or consumer, should the container be dropped, producing a shock load to the fragile glass envelope of the electric lamp. As is evident, the likelihood of breakage during handling is enhanced, should the electric lamp be free to move about in the container.

It is therefore an object of the present invention to provide a container for an electric lamp which is simple in construction and which is effective to inhibit breakage of the lamp when the container is subjected to compression, shock or vibration during handling.

A further object of the invention is to provide a container for an electric lamp which is simple in construction, being formed of a one piece blank having appropriate fold lines and cut-outs to complete the construction, without the aid of additional pieces.

Yet another object of the invention is to provide a container for an electric lamp which may be employed advantageously in the packaging of a single lamp which lamp may be of substantial size and weight while being fragile in construction.

Still another object of the invention is to provide a container for an electric lamp which can be easily assembled employing a single blank of paperboard material, rendering the construction relatively inexpensive to produce.

SUMMARY OF THE INVENTION

The aforementioned objects, and other objectives which will be become apparent as the description proceeds, are accomplished by providing a container having a parallelepiped cross-section for containing an electric lamp. The container comprises four side panels and portions at either end thereof for retaining a lamp within the four side panels.

At least one end portion of the container comprises a triangular panel disposed in the container having a hypotenuse extending between diagonally opposed corners formed by mating edges of the side panels, and a first panel that extends from the hypotenuse of the triangular panel into the container and has a free edge for contacting a portion of the lamp disposed in the container when the lamp portion contacts the triangular panel.

A second panel is disposed adjacent, and in contact with, one side panel and connects one side of the triangular panel with an end of the side panel, thus maintaining the triangular panel inwardly from the end of the side panel.

Another panel has an edge connected to the other side of the triangular panel and is disposed adjacent a second side panel extending at right angles to the one side panel and connected to it. The other panel is of quadrilateral form and has one edge opposite the connecting edge which is not parallel to the connecting edge whereby the edge opposite the connecting edge when in alignment with the end of the second side panel is effective to cant the triangular panel inwardly of the container.

In a more detailed sense, the triangular panel may be a right triangle and the semi-rigid construction formed by the triangular panel in conjunction with the first panel extending into the container provides a semi-rigid construction which serves to protect the lamp when the container is formed of a single ply sheet of paperboard material.

Further, the opposite end of the container may be constructed of a similar configuration having a second triangular panel disposed in the opposite end, and the rigidity of the structure is enhanced when the hypotenuse of the triangular panels are running from different pairs of diagonal corners of the parallelepiped cross-section of the container.

The container is manufactured from a blank comprising a substantially rectangular sheet having a plurality of parallel fold lines defining four side panels and a plurality of panels disposed at a common end of the side panels, the plurality of panels being formed by fold line and cut-out portions on the sheet.

The plurality of panels and fold lines at the common end of the side panels includes a triangular panel disposed at the end of at least one of the side panels and formed of fold lines comprising the two sides and hypotenuse of the triangle. A first quadrilateral panel has one side thereof formed by the fold line comprising the hypotenuse of the triangular panel and a pair of opposed parallel free edges extending from the one side. A fourth side is formed of a convex free edge which extends outwardly from the first panel. A second quadrilateral panel has one side thereof formed by the fold lines comprising one side of the triangular panel and a pair of free edges, each forming an acute angle with the one side of the triangle and a rectangular panel having one side formed by the fold line comprising a second side of the triangular panel and an opposed side formed of a fold line between the rectangular panel and the one side panel.

BRIEF DESCRIPTION OF THE DRAWING

The foregoing and other features of the invention will be more particularly described in connection with the preferred embodiments, and with reference to the accompanying drawing, wherein.

DESCRIPTION OF THE PREFERRED EMBODIMENT

Figure 1:
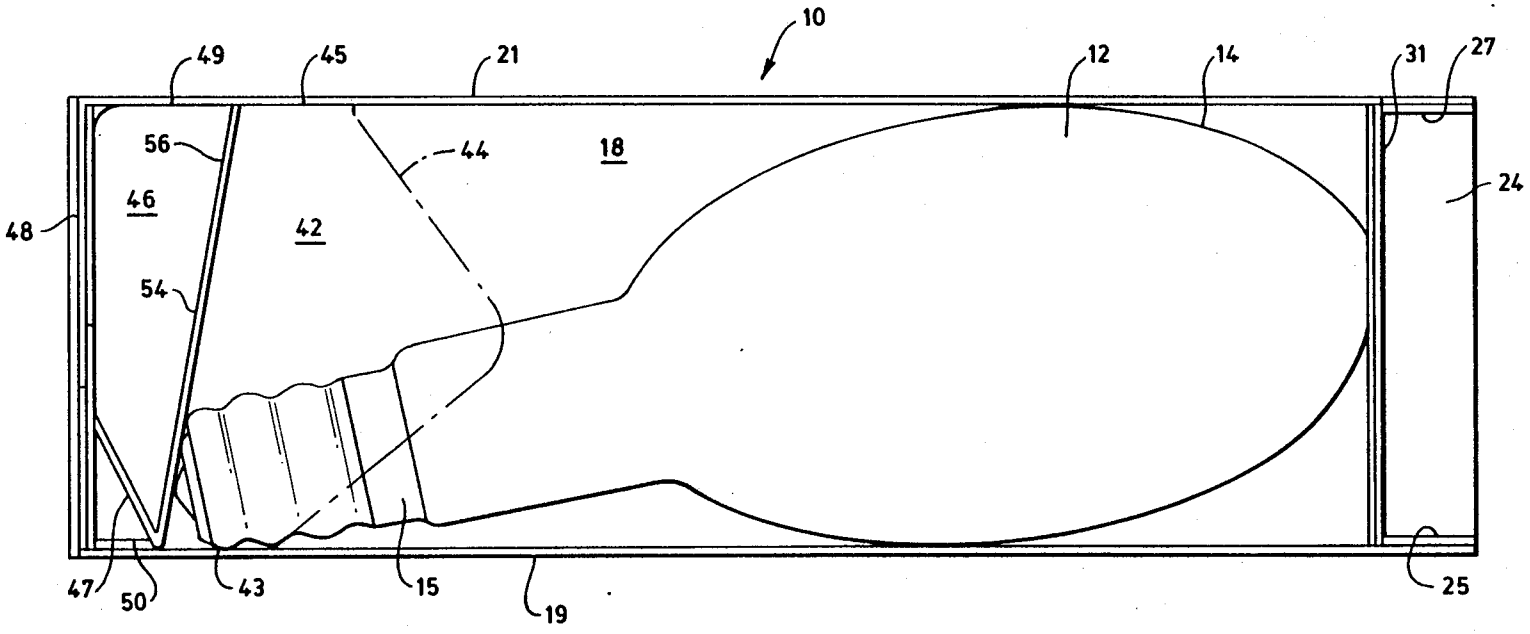
FIG. 1 is an elevational side view in section showing a preferred embodiment of a lamp container constructed in accordance with the teachings of the present invention having a sodium lamp disposed therein.

Referring to the drawing, and in particular, to FIG. 1, there is shown a container 10 having an electric lamp 12 disposed therein, the electric lamp 12 comprising a bulbous shaped glass envelope 14 at one end thereof and a threaded metallic base 15 at the opposite end.

Figure 2:
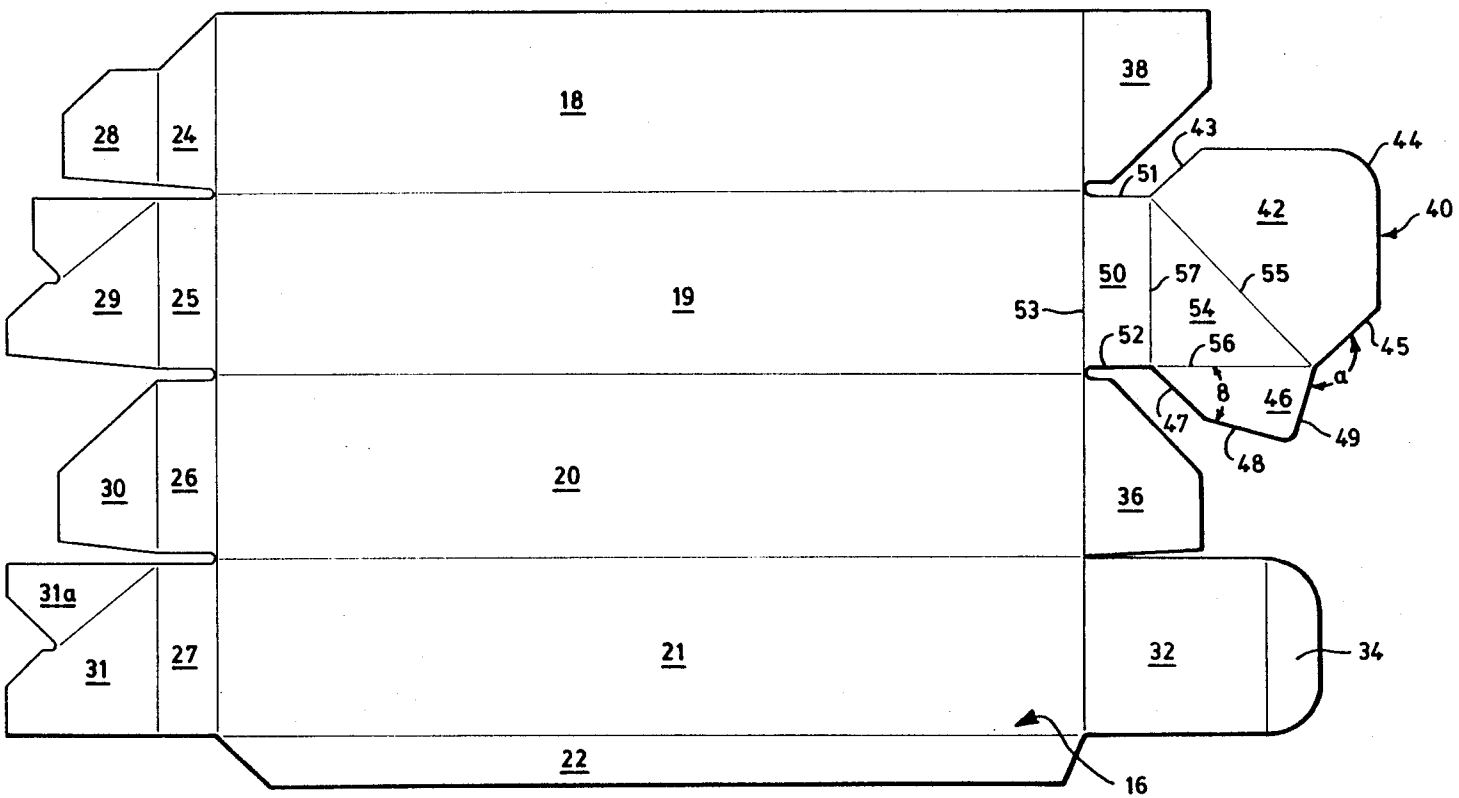
FIG. 2 is a plan view showing a blank of single ply paperboard material employed in the construction of the lamp container of FIG. 1.

Referring now to FIG. 2 taken in conjunction with the above briefly described FIG. 1, there is shown a unitary blank 16 comprising a single sheet of paperboard material which is employed in the construction of the container 10 shown in FIG. 1. The blank 16 is cut in the desired pattern as shown, and is provided with a plurality of fold lines and cut-outs which form the various walls of the container in the completed construction.

As shown in FIG. 2, the blank 16 comprises four connected side panels, 18, 19, 20 and 21, and a glue strip 22 adjacent the panel 21. In an initial step in formation of the container 10, the blank 16 is folded along the fold lines between the panels 18 and 19, the panels 19 and 20 and panels 20 and 21 to form a tubular construction of a parallelepiped form and the glue strip 22 is folded inwardly adjacent the outer edge of the panel 18 and an adhesive agent applied between the strip 22 and the inside of the panel 18 to retain the closed tubular structure in the parallelepiped form.

Referring still to FIG. 2, at one end of the panels 18, 19, 20 and 21, are formed four tuck panels 24, 25, 26 and 27, respectively. The panels 24, 25, 26 and 27 are connected to the panels 18, 19, 20 and 21 along a respective fold line and at the opposite edge of the panels 24 25, 26 and 27 is a fold line connecting end panels 28, 29, 30 and 31, respectively to the blank 16. The construction of the panels 28, 29, 30 and 31 is one which is known to form a substantially semi-rigid box end when folded together with the edges overlapped in a manner which is well known in the art. The formation of this structure will therefore not be set forth in detail. In general, with the container 10 partially assembled and in the parallelepiped form, the tuck panels 24, 25, 26 and 27 are folded inwardly adjacent the inside of the panels 18, 19, 20 and 21, and the panel 30 is first folded inwardly to a position at right angles with the tuck panel 26 after which the panel 29 and 28 are folded one over the other to cover the panel 30. The panel 31 is then folded into cover the panels 28, 29 and 30 and the tab 31*a* is tucked behind the panels 28, 29 and 30 to lock the structure into interfitting engagement, as shown in FIG. 1.

In the presently described embodiment, the end of the container 10 described above is shown as a exemplary carton end and is not part of the invention in that any similar construction which would form an end wall to the container may be employed with the present invention, as will be described below.

Referring now to the opposite end of the carton 10 from that previously described, the blank 16 from which the container is formed, is shown to comprise a substantially rectangular cover panel 32 having an insert panel 34 connected by a fold line at its end, a pair of flaps 36 and 38 and a retaining platform 40, each hingedly attached to the panels 21, 20, 18 and 19, respectively. The platform 40 comprises a first quadrilateral guide panel 42 having edges 43 and 45, a second quadrilateral leg panel 46, partially defined by edges 47, 48 and 49, a tuck panel 50 with edges 51 and 52 connected to the panel 19 at hinge line 53 and a triangular panel 54 serving to interconnect the panels guide panel 42, leg panel 46 and tuck panel 50 along hinge lines 55, 56 and 57, respectively.

Figure 3:
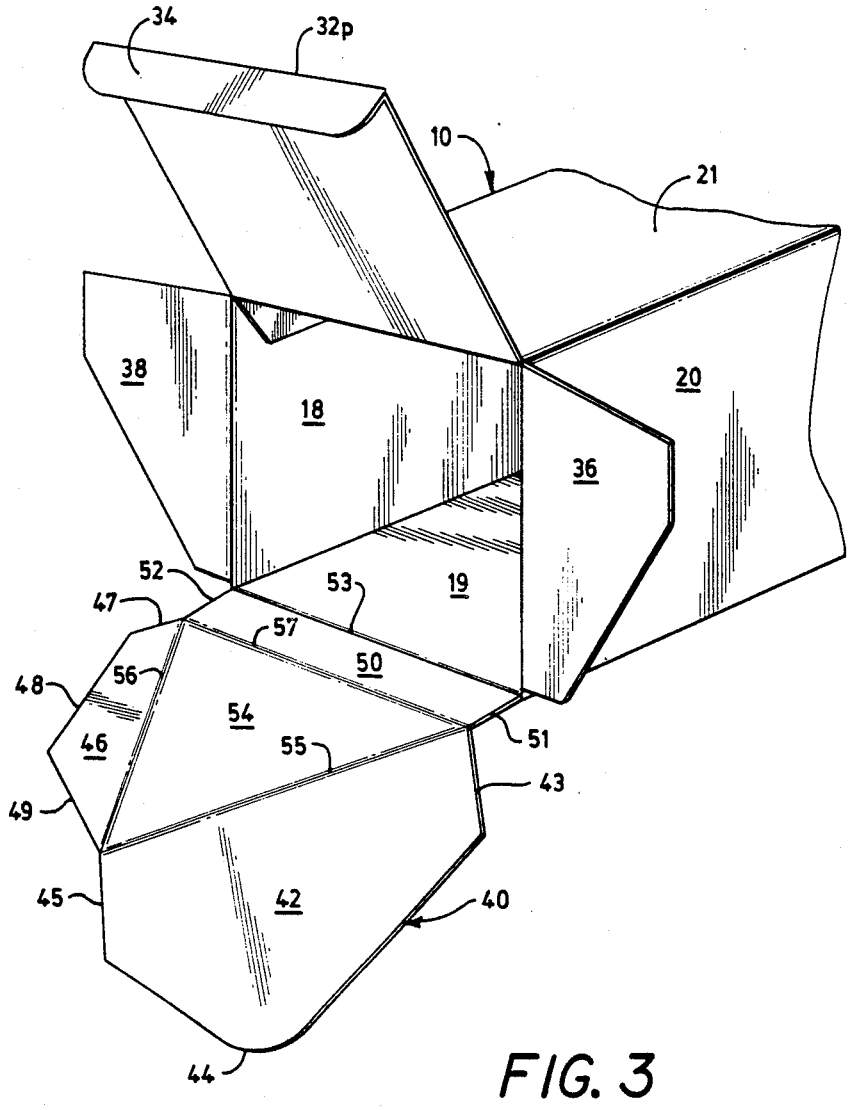
FIG. 3 is a perspective end view of the lamp container of FIG. 1 showing the container in its partially assembled form.
Figure 4:
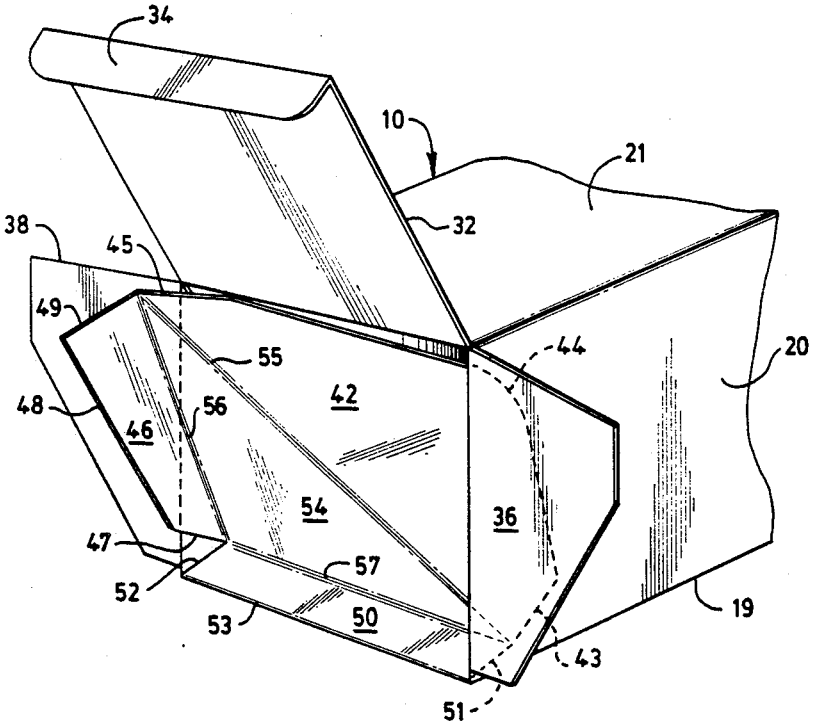
FIG. 4 is a perspective end view similar to FIG. 3 showing the lamp container of FIG. 1 in a further step of assembly subsequent to that of FIG. 3.
Figure 5:
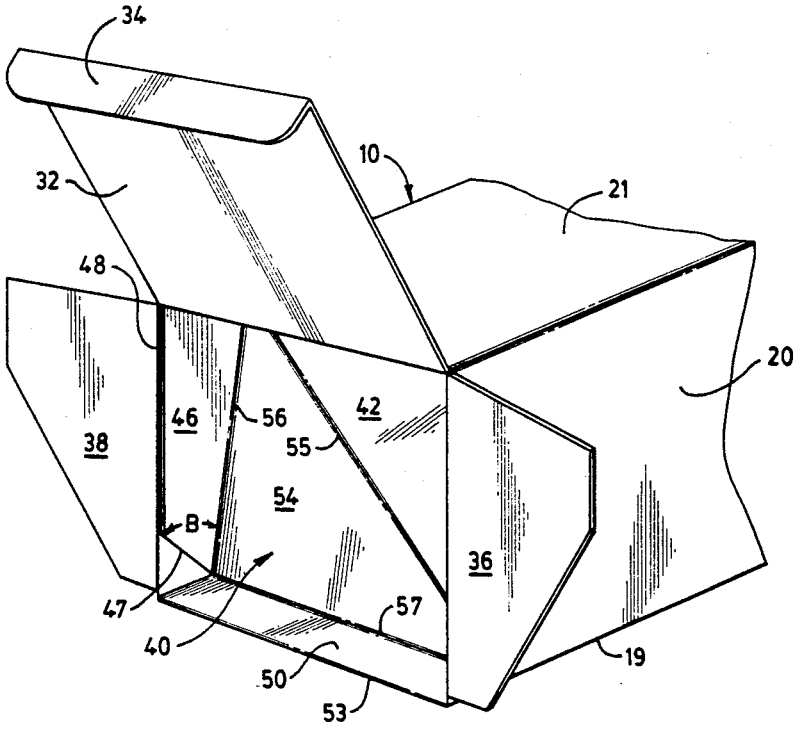
FIG. 5 is a perspective end view similar to FIG. 3 and FIG. 4 showing the final assembly of the lamp container end depicted in FIGS. 3 and 4.

With reference now to FIGS. 3, 4 and 5 of the drawing, the container 10 is shown in its partially assembled form with the side panels 18, 19, 20 and 21 formed into a parallelepiped tube. In FIG. 3, the cover panel 32 and the flaps 36 and 38 are shown in an open position and with the retaining platform 40 extending downwardly, being connected to the side panel 19 by the tuck panel 50.

As shown in FIG. 4, the first step of assembly consists of rotating the tuck, panel 50 inwardly toward the side wall 19, and folding the guide and leg panels 42 and 46 in opposite directions along the bend lines 55 and 56. The guide panel 42 extends inwardly of the container 10 and the leg panel 46 extends outwardly from the container. The tuck panel 50 is then rotated to a position in contact with the side panel 19 and the triangular panel 54 swung inwardly about the hinge line 57 until the edge 43 of the quadrilateral guide panel 42 is in alignment with the seam or fold line between the panels 19 and 20, and the edge 45 of the quadrilateral guide panel 42 is in contact and aligned with the fold line between the side panels 18 and 21. The hypotenuse of the triangular panel 54 then extends diagonally between opposite seam lines. The angle A between the edges 45 and 49, as shown in FIG. 2 is such that with the edge 49 of the quadrilateral leg panel 46 disposed in the fold line between the panels 18 and 21, and the edge 45 of the guide panel 42 also located in the hinge line between the panels 18 and 20, the triangular panel 54 is retained in place as shown in FIG. 5.

Referring to FIG. 5, taken in conjunction with FIG. 1, the container 10 with the retaining platform 40 in place, as shown in FIG. 5, is completed by folding the flaps 38 and 36 inwardly and closing the cover panel 32 over the opening, with the insert panel 34 adjacent the tuck panel 50.

With the structure thus assembled, the panel 54 is disposed at a slight angle B with the cover panel 32 but being retained in position by the quadrilateral leg panel 46 and the tuck panel 50 from movement in the longitudinal direction of the container 10.

The panel 54 is canted inwardly of the container 10 by virtue of the edge 48 and the fold line 56 being non-parallel at angle B, and is held in position when the edge 48 is aligned with the end of the panel 18 and retained by the flap 38 in the container is closed.

The guide panel 42 having its edges 43 and 45 retained at the corners of the parallelepiped in the hinged portions between the panels 20 and 21, and the panels 18 and 19, adds to the rigidity of the panel 54 along the hypotenuse 55 and therefore enhances the ability of the container 10 to withstand side loads which would cause relative movement of opposite side panels of the container and collapse of the container.

As shown in FIG. 1, the lamp is placed in the container 10 prior to the assembly operation described above and either the bulbous envelope end 14 or metallic base 15 may be placed in contact with guide panel 42, or panel 54 when the panel 54 is folded inwardly, the guide panel 42 being rigidly held by the edges 45 and 43 but having the edge 44 free to flex to accommodate that portion of the lamp envelope 14 adjacent the lamp 12. The lamp is thus fixed against axial movement in the container 10 by the rigidity of the canted panel 54. The canted panel 54 is supported in part by the first quadrilateral guide panel 42 being caught in the side panel seams, and being angled to the canted panel. The hypotenuse 55 is thereby strengthened. The canted panel 54 is further supported by the second quadrilateral leg panel 46, and tuck panel 50 acting as footers. Since the canted panel 54 is offset from the cover panel 32, direct blows to the end of the carton are not transmitted through the paperboard to the lamp. The canted panel 54 may flex, but remains supported by the adjacent attached panels, and due to the cant tends to force the side panels outwards against the rigidity of the four side panels, and any adjacent cartons. The lamp is also positioned and restricted in movement in the container by virtue of the edge 44 of the guide panel 42 which contacts the lamp 12 to force the lamp into a position contacting the panels 18 and 19. The first quadrilateral guide panel 42 then acts as a flexible tongue that guides and positions the lamp end. The lamp is restricted from slipping off the canted panel by the guiding tongue action. The quadrilateral guide panel 42 may also flex or twist laterally on axial contact with the lamp to further cushion axial lamp motion.

An actual carton to contain a 100 watt 19 cm long, 7.5 cm diameter, large base sodium lamp weighing 156 gm was constructed. The side panels were 22.2 cm by 7.5 cm. The tuck panel was 1.9 cm by 7.5 cm with parallel sides. The triangular platform panel was a right triangle having sides of about 7.3 cm (1.0 mm score lines) and a hypotenuse of 10.3 cm. The first quadrilateral panel had parallel side edges 2.2 cm at 90° to the hypotenuse, and a fourth convex free edge formed roughly as a right triangle with a broadly rounded corner. The second quadrilateral panel was hinged to a side of the triangle panel. The opposite side was angled about 10° (angle B) to the triangle. The insert edge was about 3.1 cm. The angle between the first insert edge and the second insert edge (angle A) was about 150°. When folded, the tuck flap lay adjacent the inner surface of the adjacent side panel. The sides of the triangular panel fit snugly against the side panels. The hypotenuse spanned at an axial angle a diagonal of the carton between opposite seams. The triangle was tilted into the carton from the tuck panel. The first quadrilateral panel extended from the hypotenuse into the carton dividing the carton parallel with the axis, and forming a trapping compartment with the side walls and the triangle panel. The free edge of the first quadrilateral panel pressed against the lamp envelope. The second quadrilateral panel lay flat against the adjacent side panel, and held the triangle panel at an angle B with respect to the end of the carton. The end of the carton was sealed by two flaps and a tucking end panel that added further stiffening and shock absorption offset from the support triangle. The carton is loadable by hand or by machine.

Figure 6:
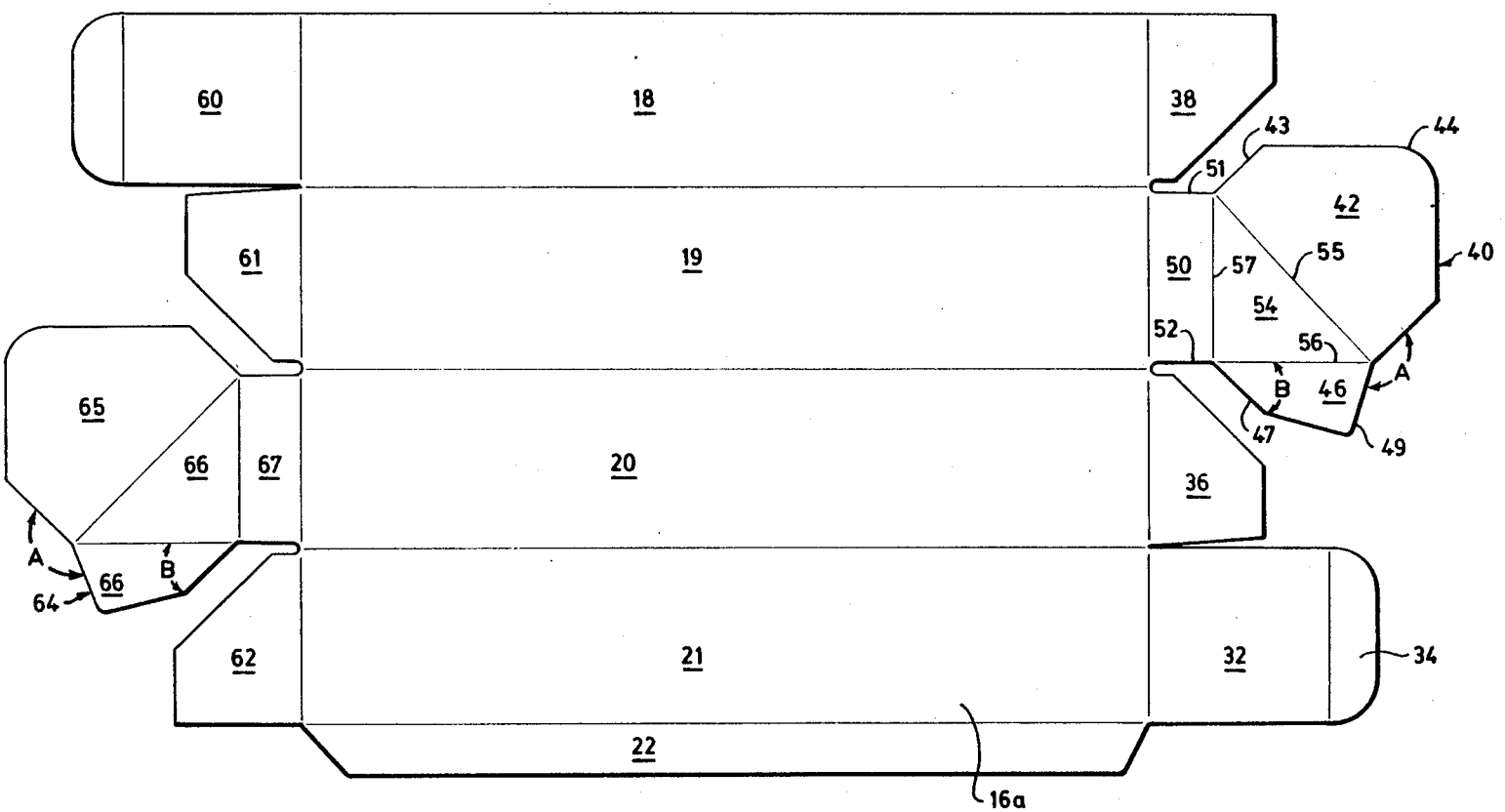
FIG. 6 is a plan view showing a blank of single ply paperboard material employed in the construction of an alternate embodiment of the lamp container shown in FIGS. 1 through 5.

In FIG. 6, there is shown a blank **16*a* which is an alternate embodiment of the blank 16 wherein like elements have been given like reference numerals as those shown in FIG. 2. It will be noted that at the opposite end of the blank 16*a*, the panels 24 through 31 have been replaced by panels 60 through 68. The structural members at either end of the blank 16*a* are now similar in that panel 60 is similar to panel 32, the panels 61 and 62 are similar to panels 38 and 36, and the retaining platform 64 having panels 65, 66, 67 and 68, is similar in structure to the platform 40 having panels 42, 46, 50 and 54. The structure formed by the blank 16*a* therefore provides a container having a platform 64 as well as a platform 40, one disposed at either end of the container. The manner of assembly of the blank 16*a* into a container will not be described here in detail as either end of the container is now capable of being assembled, as described with regard to the panels 32, 36, 38 and the retaining platform 40 described above. It will further be noted that with the platforms 40 and 64 mounted on adjacent side panels 19 and 20, the quadrilateral panels 42 and 65 will be disposed between different diagonal corners from one another and the triangular panels 68 and 54 will each have its hypotenuse direction running between different diagonal corners of the container to further add to the rigidity of the container formed by the blank 16*a***.

A container constructed from the blank **16*a* shown in FIG. 6 is therefore capable or retaining a lamp 12 with the metallic base 15 disposed behind the panel 42, as shown in FIG. 1 and the glass envelope 14 disposed in contact with the panel 65** to maintain the lamp cushioned in the container.

In each of the embodiments shown, the tuck panels 50 and 67 cause the platform 40 and 64 to be recessed from the end of the container further preventing damage to the lamp 12 due to end loading.

Either the blank 16 or the blank **16*a* is preferably formed from a singular sheet of material. The material is preferably of a single ply construction and does not need to include corrugation or similar convoluted features as the construction described hereinbefore eliminates the need for such, as well as the need for additional elements to be glued in the container to form separate compartments. The materials which are suitable for the manufacture of the blank 16 or 16***a* include bleach sulfate, chipboard, bleach manila and machine clay coated newspack, and the thickness of the paperboard material may be in the range from 0.012 inches to about 0.18 inches.

The invention therefore provides a lamp container which is simple in construction, easily assembled and one which will retain the integrity of the lamp contained in the container during shipping or handling by the manufacturer, distributor or user.

While it is obvious that changes and modifications may be made within the spirit and scope of the present invention, it is my intention, however, only to be limited by the appended claims.

I claim:

1. A blank for forming a lamp container comprising a substantially rectangular sheet having a plurality of parallel fold lines including in sequence a first side panel edge line, a second side panel fold line, a third side panel fold line, a fourth side panel fold line, and a fifth side panel fold line defining by respective pairs in sequence a first side panel, a second side panel, a third side panel, a fourth side panel, and a sealing means, of said container, and a plurality of end panels disposed at a common first end of said side panels, said plurality of common first end panels being formed by fold lines and cut-out portions on said sheet and including:

(a) a rectangular panel coupled to said first end of said second side panel along a first end panel coupling fold line transverse to said second side panel fold line, and transverse to said third side panel fold line, (b) a triangular panel defined by a first fold line having a base length, a second fold line having a height, and a third fold line; the triangular panel being disposed adjacent, and coupled along said first fold line of said triangular panel to a side of said rectangular panel opposite said first end panel coupling fold line, with said second fold line of said triangular panel opposite said third side panel fold line, (c) a leg panel having one side thereof formed along said second fold line of said triangular panel and having a side opposite said second fold line of said triangular panel, not parallel with said second fold line of said triangular panel, and extending for a distance less than or equal to the perpendicular distance between said third side panel fold line and said fourth side panel fold line, and (d) a guide panel having a first side coupled along said third fold line of said triangular panel, said guide panel having a second side opposite the third fold line of said triangular panel having a free edge including at least one point whose distance, projected parallel to the first fold line of said triangular panel, to the second fold line of said triangular panel, and whose distance, projected parallel to the second fold line of said triangular panel, to the first fold line of said triangular panel are not both less than the base length and height length respectively.

2. A blank for forming a lamp container as set forth in claim 1 wherein said triangular panel is a right triangle in form.

3. A blank for forming a lamp container as set forth in claim 1 wherein said rectangular sheet is a single ply paperboard material.

4. A blank for forming a lamp container as set forth in claim 1 further including a pair of flap panels disposed on said common first end of said nonadjacent first and third side panels, each flap panel being formed on said respective side panels by a respective fold line; and a rectangular cover panel formed on said common first end of said fourth side panel being connected to said fourth side panel by a fold line forming a first edge thereof connecting said cover panel to said fourth side panel, said cover panel having an insert panel disposed along and coupled to a second edge opposite the first edge of the cover panel.

5. A blank for forming a lamp container as set forth in claim 1 further comprising a plurality of second end panels disposed at the opposite, second ends of said side panels from said common first end, said plurality of second end panels being formed by fold lines and cut-out portions on said sheet and including:

(a) respective second rectangular panel coupled to said second end of said third side panel along a respective second end panel coupling fold line transverse to said third side panel fold line, and transverse to said fourth side panel fold line, (b) a respective second triangular panel defined by a first fold line having a second length, a second fold line having a second height, and a third fold line; the triangular panel being disposed adjacent, and coupled along said first fold line of said second triangular panel to a side of said second rectangular panel opposite said second end panel coupling, with said second fold line of said second triangular panel opposite said fourth side panel fold line.

(c) a respective second leg panel having one side thereof formed along said second fold line of said second triangular panel, and extending for a distance less than or equal to the perpendicular distance between said fourth side panel fold line and said firth side panel fold line, and (d) a respective second guide panel having a first side coupled along said third fold line of said second triangular panel, said guide panel having a second side opposite the third fold line of said second triangular panel having a free edge including at least one point whose distance, projected parallel to the first fold line of the second triangular panel, to the second fold line of the second triangular panel, and whose distance, projected parallel to the second fold line of the second triangular panel, to the first fold line of the second triangular panel are not both less than the respective second length and respective second height respectively.

6. A blank for forming a lamp container as set forth in claim 5 wherein each said triangular panel and said second triangular panel are right triangles and are formed on said common first end and said opposite second end of a respective said side panel such that said third fold of said triangular panel and said third fold of said second triangular panel are not parallel when said triangular panel and said second triangular panel are folded towards one another on the same side of said rectangular sheet to form a right angle with said rectangular sheet.

7. A blank for forming a lamp container as set forth in claim 5 wherein said second triangular panel is a right triangle in form.

8. A blank for forming a lamp container as set forth in claim 6 wherein said rectangular sheet is a single ply paperboard material.

9. A blank for forming a lamp container as set forth in claim 5 further including a second pair of flap panels disposed on said second end of said second side panel and said fourth side panel, each flap panel being formed along a respective fold line with said respective, adjacent side panel; and a respective second rectangular cover panel formed on said second end of said first side panel being connected to said first side panel by a fold line forming one edge thereof, connecting said cover panel to said first side panel and having an insert panel disposed at the opposite edge thereof and connected by another fold line.

10. A blank for forming a lamp container as set forth in claim 9 wherein each side triangular panel and said second triangular panel are right triangles and are formed on said common first end and said opposite second end of a respective said side panel such that said third fold of said triangular panel and said third fold of said second triangular panel are not parallel when said triangular panel and said second triangular panel are folded towards one another on the same side of said sheet to form a right angle with said rectangular sheet.

11. A parallelepiped cross-section container for an electric lamp having four side panels coupled pairwise sequentially along parallel mating edges and a pair of end portions disposed at opposite ends of said side panels for retaining the lamp within said four side panels of the container, at least one end portion having:

a triangular panel disposed in said container having a first side thereof extending diagonally between opposed corners formed by said mating edges of said side panels, a second side thereof in contact with a first of said respective side panels, and a third side thereof in contact with a second of said respective side panels;

a guide panel extending from said first side of said triangular panel into said container and having a free edge for contacting at least one of said side panels, and a surface of said guide panel disposed to contact a portion of a lamp disposed in said container;

a rectangular panel disposed adjacent said first side panel and having a first edge coupled to said first side panel and connecting along a second side of said rectangular panel opposite said first side of said rectangular panel to said second side of said triangular panel; and a leg panel having a first edge connected to said third side of said triangular panel and disposed adjacent said second of the respective side panels.

12. A container as set forth in claim 11 wherein said leg panel is quadrilateral, and has a second edge opposite said first edge connecting with said third side of said triangular panel which is not parallel to said connecting first edge whereby with said second edge opposite said connecting first edge when in alignment with said first end of said second side panel, causes said triangular panel to be canted inwardly of said container.

13. A container as set forth in claim 11 wherein said container is formed of a single sheet of material and said panels are formed by a plurality of folds and cut-outs in said sheet.

14. A container as set forth in claim 11 wherein said triangular panel is a right triangle in form.

15. A container as set forth in claim 1 wherein said triangular panel is formed of a single ply sheet of paperboard material.

16. A container as set forth in claim 11 wherein said second end of said container comprises a second triangular panel disposed in the container having a first side thereof extending diagonally between opposed corners formed by mating edges of said side panels and a panel extending from a first side of said second triangular panel into said container for contacting a second portion of a lamp disposed in said container with the lamp second portion contacting said second triangular member.

17. A container as set forth in claim 11 further including a pair of flap panels, each flap panel connected to a respective opposite side panels and substantially covering said end of said container, and a cover panel contacting said flap panels and having an insert panel extending into said container, one of said flap panels contacting said edge of said leg panel opposite said connecting edge to support said leg panel and said triangular panel in position in said container.

18. A container as set forth in claim 16 wherein said leg panel further comprises a free edge disposed between said connecting edge and said edge opposite said connecting edge, said free edge being disposed in a corner formed by a pair of mating side panels to further support said leg panel and said triangular panel in position in said container.

19. A container as set forth in claim 17 wherein said triangular panel is a right triangle.

20. A container as set forth in claim 19 wherein said container is formed by a single ply sheet of paperboard material.

* * * * *